US005111870A

United States Patent [19]

Cook

[11] Patent Number: 5,111,870

[45] Date of Patent: May 12, 1992

[54] TOP FILL CASTING

[75] Inventor: Arnold J. Cook, Pittsburgh, Pa.

[73] Assignee: PCast Equipment Corporation, Pittsburgh, Pa.

[21] Appl. No.: 596,062

[22] Filed: Oct. 11, 1990

[51] Int. Cl.[5] ..... B22D 18/00; B22D 19/14

[52] U.S. Cl. ..... 164/61; 164/66.1; 164/97; 164/119; 164/127; 164/259; 164/284; 164/306; 164/337

[58] Field of Search ..... 164/61, 63, 66.1, 68.1, 164/97, 119, 259, 284, 306, 309, 337, 127

[56] References Cited

U.S. PATENT DOCUMENTS

| | | | |
|---|---|---|---|
| 3,547,180 | 12/1970 | Cochran et al. | 164/61 |
| 3,712,364 | 1/1973 | Daniel et al. | 164/63 X |
| 4,597,431 | 7/1986 | Hobo et al. | 164/258 X |
| 4,762,165 | 8/1988 | Ogino et al. | 164/61 X |
| 4,770,704 | 9/1988 | Gibson et al. | 164/122.1 X |
| 4,789,140 | 12/1988 | Lirones | 164/337 X |
| 4,832,105 | 5/1989 | Nagan et al. | 164/61 |
| 4,919,191 | 4/1990 | Brodersen | 164/61 X |

*Primary Examiner*—J. Reed Batten, Jr.
*Attorney, Agent, or Firm*—Ansel M. Schwartz

[57] ABSTRACT

The apparatus for casting comprises a pressure vessel and a device for evacuating and pressurizing the vessel. The evacuating and pressurizing device is in fluidic connection with the vessel. The apparatus is also comprised of a chamber disposed in the pressure vessel within which material is melted. There is a mold with a passage such that the melted material in the chamber can be forced down into the mold through the passage as the pressurizing device pressurize the vessel. The passage contains a filter such that the melted material is prevented from entering the interior of the mold prior to pressurization. Additionally, the apparatus is comprised of a device for heating material in the chamber and the mold such that material is melted in the chamber and stays melted as it is forced down into mold while the pressurizing device pressurizes the vessel. The heating device is disposed in the vessel. The apparatus is comprised of a chill plate for cooling the mold and a chill plate lifter for selectively moving the chill plate into and out of contact with the bottom of the mold during operation. Additionally, the invention is a method for casting fiber reinforced materials which disclose a top fill and the step of cooling the mold after infiltration.

14 Claims, 2 Drawing Sheets

TOP FILL CASTING

FIELD OF THE INVENTION

The present invention is related to casting. More specifically, the present invention is related to an apparatus and method for pressure casting whereby the material is forced into a mold from the top.

BACKGROUND OF THE INVENTION

Composite products comprising a metal matrix and a reinforcing phase such as ceramic particulates, show great promise for a variety of applications because they combine the stiffness and wear resistance of the reinforcing phase with the ductility and toughness of the metal matrix.

Various metallurgical processes have been described for the fabrication of aluminum matrix composites. These methods are, for instance, based on powder metallurgy techniques and liquid metal infiltration techniques which make use of pressure casting, vacuum casting, stirring and wetting agents. Pressure Infiltration Casting as described in U.S. patent application No. 07/325,221 by Arnold J. Cook and entitled "Method and Apparatus for Casting" and now abandoned described pressure casting apparatus whereby the mold, metal and heating means are contained within a pressure vessel. The described method for casting essentially comprises the steps of evacuating the pressure vessel while melting the metal within a crucible. The mold, which has a snorkel, is disposed on top of the crucible. The molten metal is fluidically connected to the mold by disposing the snorkel in the crucible of molten metal, thereby isolating the inside of the mold from the interior of pressure vessel. Inert pressurized gas is then used to force the molten metal into the mold. This method necessitates separate steps for melting the metal and fluidically isolating the inside of the mold from the interior of the pressure vessel. Further, a mechanical apparatus, such as a crucible lifter, is needed to connect the snorkel and melted metal before pressurization.

An improvement of this process and apparatus is described in the present invention whereby solid metal is disposed in a chamber on top of the mold. A passage fluidically connects this chamber to the inside of the mold. As the metal is melted, the molten metal covers the passage thereby fluidically isolating the inside of the mold from the interior of the vessel in one step.

SUMMARY OF THE INVENTION

An apparatus comprises a pressure vessel and a device for evacuating and pressurizing the vessel. The evacuating and pressurizing device is in fluidic connection with the vessel. The apparatus is also comprised of a chamber disposed in the pressure vessel within which material is melted. There is a mold with a passage such that the melted material in the chamber can be forced down into the mold through the passage as the pressurizing means pressurizes the vessel. The passage contains a filter such that the melted material is prevented from entering the interior of the mold prior to pressurization. Additionally, the apparatus is comprised of a device for heating material in the chamber and the mold such that material is melted in the chamber and stays melted as it is forced down into mod while the pressurizing device pressurizes the vessel. The heating device is disposed in the vessel.

Additionally, there is a method comprising the steps of loading the pressure vessel by disposing the material within the chamber whereby the material is in fluidic connection with the mold through the passage. The passage has a filter disposed therein. Then, the pressure vessel is evacuated. Next, the material is melted in the crucible whereby the melted material fluidically seals the passage thereby isolating the interior of the mold from the interior of the vessel. The filter prevents melted material from entering the interior of the mold. Next, the vessel is pressurized at a controlled rate such that the melted material is forced past said filter and into the interior of the mold and into the preform.

BRIEF DESCRIPTION OF THE DRAWINGS

In the accompanying drawings, the preferred embodiments of the invention and preferred methods of practicing the invention are illustrated in which:

FIGS. 2A-2G are cross-sectional schematic views showing an apparatus and a method for top fill casting when a substantial temperature differential between the mold and material is desired.

DESCRIPTION OF THE PREFERRED EMBODIMENT

Figure 1A:
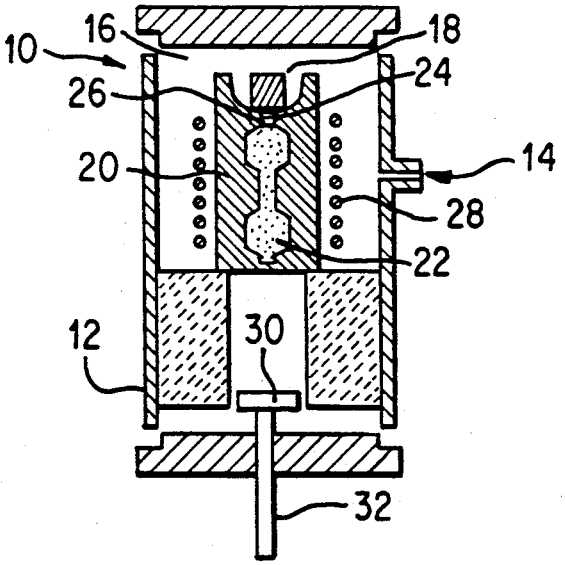
FIGS. 1A-1F are cross-sectional schematic views showing the top fill casting method.

Referring now to the drawings wherein like reference numerals refer to similar or identical parts throughout the several views, and more specifically to FIG. 1A thereof, there is shown a cross-sectional schematic view of an apparatus 10 for casting. The apparatus 10 comprises a pressure vessel 12 and means for pressurizing and evacuating the vessel. The vessel 12 is preferably made of steel. The evacuating and pressurizing means are in fluidic connection with the vessel 12 through port 14. The apparatus 10 is also comprised of a chamber 16 disposed in the pressure vessel 12 within which material 18, such as aluminum, is melted. There is a mold 20 disposed in the pressure vessel 12 within which a preform 22 is held although the invention is not in any way limited to the presence of a preform 22 within the mold 20. A passage 24 fluidically connects the chamber 16 to the interior of mold 20. Preferably, a filter 26, such as a porous ceramic insert, is disposed within the passage 24 such that the melted material 18 is prevented from entering the interior of mold 20 while the vessel 12 is unpressurized. The mold 20 is preferably made of 304 stainless steel, however, other materials can also be used such as investment material. The preform 22 is preferably made of silicon carbide fibers.

Since the mold 20 is in fluidic connection with the melted material 18, melted material 18 in the chamber 16 can be forced down into the mold 20 as the pressurizing means pressurizes the vessel 12. Typical pressures for use with silicon carbide fibers, and melted aluminum are 1000 PSI-2000 PSI and preferably 1300 PSI-1500 PSI. The pressure required is related to the volume fraction of fibers. In general, the more fibers per given unit of volume, the greater pressure is required to force the melted material between the fibers.

The apparatus is also comprised of means for heating material 18 in the chamber 16 and mold 20 such that material 18 is melted in the chamber 16 and stays melted as it forms a liquid seal over the passage 24 and when it is forced into the mold 20 while the pressurizing means pressurizes the vessel 12. The heating means is preferably disposed in the vessel 12. The heating means should provide enough heat to maintain the material in a melted state. For instance, with aluminum, the temperature should be over 600° C. and preferably between 650° C. and 700° C. The heating means preferably includes a furnace 28 for heating the mold 20 and material 18 and is preferably positioned about the mold 20 to provide essentially uniform heating to the mold 20, preform 22 and material 18, respectively.

Figure 1B:
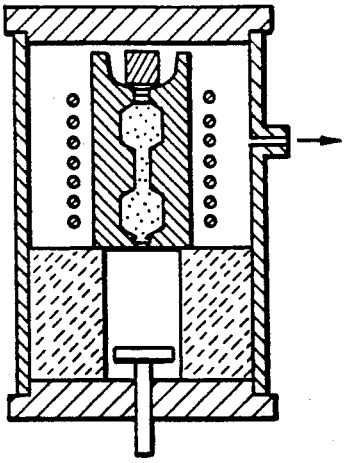
Figure 1C:
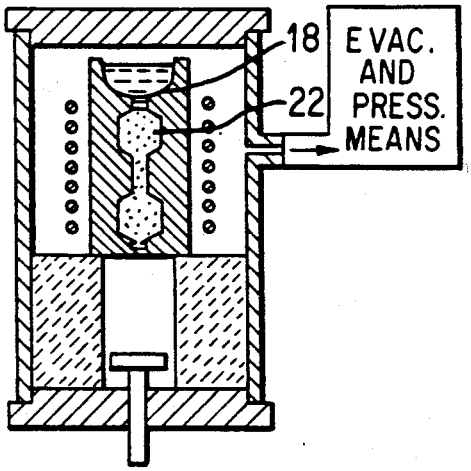
Figure 1D:
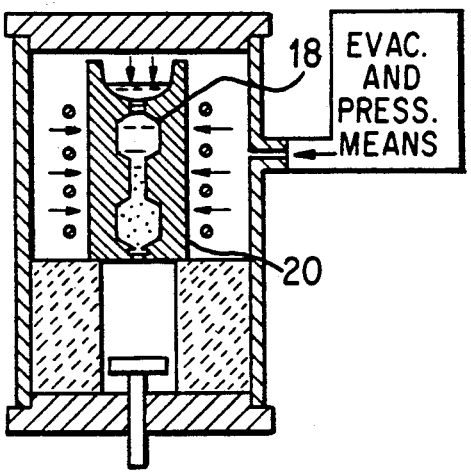
Figure 1E:
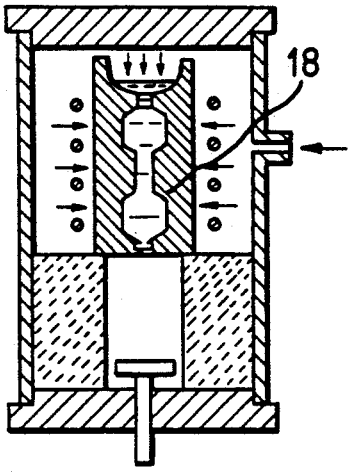
Figure 1F:
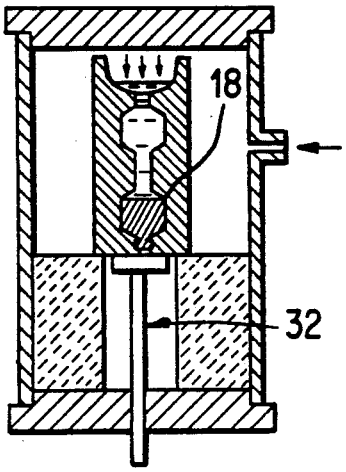

Preferably, the apparatus 10 includes a chill plate 30 connected to a chill plate lifter 32 for lifting the chill plate 30 such that it is placed in thermal contact with the bottom of mold 20, as shown in FIG. 1F. FIG. 1F is a cross-sectional schematic view of an apparatus 10 with the mold 20 in thermal contact with the chill plate 30 after chill plate lifter 32 has lifted the chill plate 30. (Note: FIGS. 1A-1F are is drawn to scale so that the relationship of the various elements and structures thereof are defined regardless of the actual size chosen therefore.)

Figure 2A:
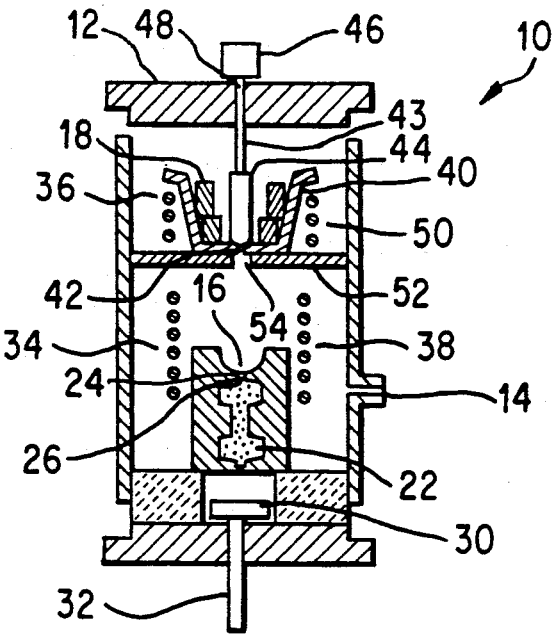

In an alternative embodiment and referring to FIG. 2A, the vessel 12 comprises a mold section 34 and a melt section 36. The mold 20 within which the preform 22 is held is disposed beneath the chamber 16 in the mold section 34. The mold section is in the lowermost portion of vessel 12 and comprises its own heating means, preferably a mold furnace 38, such that the mold furnace 38 allows the material to remain melted as it enters the mold 20 and the preform 22. It should be noted, however, that the mold furnace 38 is not necessary for the effective operation of the apparatus 10.

Figure 2B:
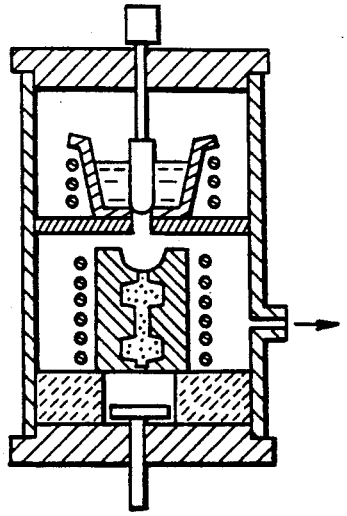
Figure 2C:
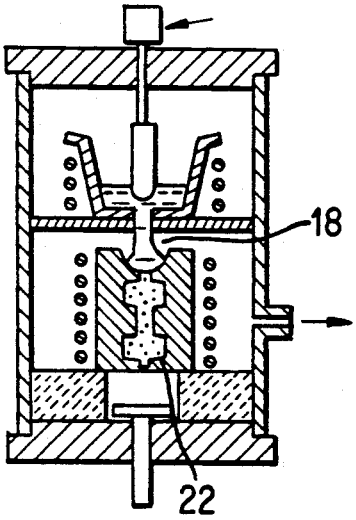

The melt section comprises a crucible 40 within which material 18 is stored and melted. The crucible 40 has a hole 42 disposed through its bottom surface. A plug 44 of plug lift system 46 fluidically seals and opens the hole 42, as the plug lifter 48 of plug lift system 46 raises and lowers the plug 44. The plug 44 is preferably made of ceramic. The melt section further comprises heating means such that the material 18 in crucible 40 is melted and stays melted as it flows through hole 42 as plug lifter 48 is raised. For instance, with aluminum, the temperature should be over 600° C. and preferably between 650° C. and 700° C. The heating means preferably includes melt furnace 50 positioned about the crucible 40 to provide essentially uniform heating to the material 18. The mold section 34 and melt section are separated by an insulative barrier 52 having an insulation hole 54 disposed below the hole 42 of crucible 40 such that the melted material in crucible 40 can flow through hole 42 and insulation hole 54, as the plug lifter 48 raises the plug 44 away from hole 42 as shown in FIG. 2C. The insulative material 52 maintains a heat differential between the melt section and the mold section.

The present invention also pertains to a method for producing a fiber reinforced material. The method comprises the steps of loading a mold 20 containing a preform 22 and having a passage 24 within the pressure vessel 12. A filter 26 is disposed within the passage 24. Then, the step of placing in the chamber 16 of the pressure vessel 12 the material 18, as shown in FIG. 1A is performed. Next, the step of evacuating the pressure vessel 12 through the port 14 as shown in FIG. 1B is performed. Then, the step of melting the material 18 in the chamber 16, as shown in FIG. 1C, is performed. Next, the step of pressurizing the vessel 12 such that the melted material 18 is forced down into the mold 20 and forced into the preform 22, as shown in FIG. 1D, is performed. The pressurizing step preferably includes the step of controlling the rate at which pressurization of the vessel 12 occurs such that the pressure in the mold 20 is able to have time to be driven toward instantaneous equilibrium with the pressure in the vessel 12. Then, the step of raising the chill plate lifter 32 allowing the chill plate 30 to thermally contact the bottom of mold 20, as shown in FIG. 1F, is performed, thereby initiating directional solidification. Then pressure is released and the mold 20 is removed from the pressure vessel 12.

Figure 2D:
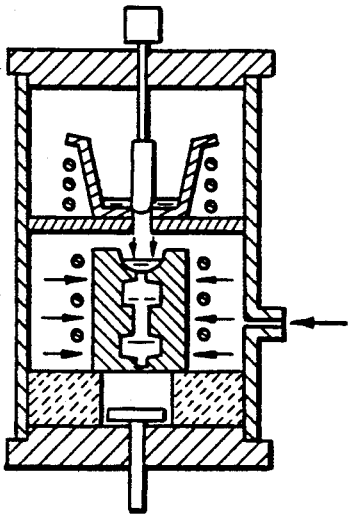
Figure 2E:
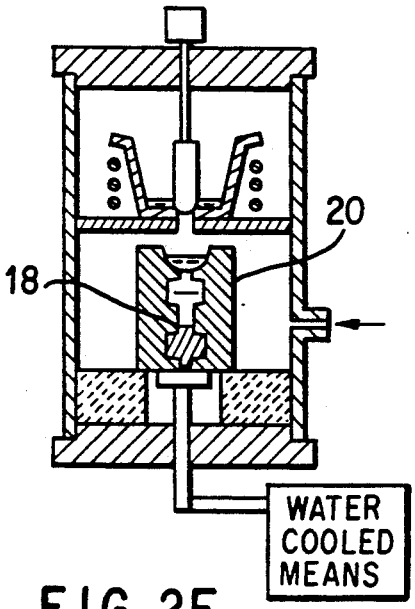

The present invention also pertains to a method for using the pressure vessel having separate sections, a melt section 36 and a mold section 34 to produce a fiber reinforced material. The method comprises the steps of loading the pressure vessel by disposing the mold 20, containing a preform 22 and a filter 26 in the mold section 34 of the pressure vessel 12 and placing the crucible 40 containing material 18 within the melt section of the pressure vessel 12 such that the plug 44 of plug lift system 46 seals the hole 42 of crucible 40, as shown in FIG. 2A. Next, the step of evacuating the pressure vessel 12 through port 14 as shown in FIG. 2B is performed. Then, the step of melting the material 18 in crucible 40, as also shown in FIG. 2B is performed. Then, the step of lifting the plug 44 with plug lifter 48 is performed thereby allowing the melted material 18 to flow through hole 42 and insulation hole 54 and into the chamber 16. Then, the step of pressurizing the vessel 12 such that the melted material 18 is forced down into the mold 20 and forced into the preform 22, as shown in FIG. 2D, is performed. The pressurizing step preferably includes the step of controlling the rate at which pressurization of the vessel 12 occurs such that the pressure in the mold 20 is able to have time to be driven toward instantaneous equilibrium with the pressure in the vessel 12. Then, the step of raising the chill plate lifter 32 allowing the chill plate 30 to thermally contact the bottom of mold 20 thereby initiating directional solidification as shown in FIG. 2E is performed. Then, pressure is released and the mold 20 is removed from the pressure vessel 12.

In the operation of the preferred embodiment, the chamber 16 is loaded with aluminum and placed in the vessel 12 which is then sealed, preferably with high temperature VITON® seals. The vessel is then evacuated through port 14, as shown in FIG. 1B thereby removing any gas from the vessel 12. The mold furnace 28 is then activated to melt the aluminum in chamber 16, as shown in FIG. 1C, while the vessel is continuously evacuated. By evacuating the vessel 12 and mold 20, there is less chance of voids being formed in the fiber reinforced material after the melted material has infiltrated the preform 2.

As the aluminum in the chamber 16 is melted, the melted aluminum covers the passage 24 thereby fluidically isolating the interior of the mold 20 from direct communication with the vessel interior such that the melted aluminum in the chamber 16 can be forced down into mold 20 and preform 22 through the passage 24 under the action of the pressurization means, as shown in FIG. 1D.

Once the melted aluminum has been melted, the pressurization means introduces pressurized nitrogen gas into the vessel 12, as shown in FIG. 1D. The pressure in the vessel 12 is consequently increased throughout the vessel 12 and specifically at the surface of the melted aluminum in the chamber 16. As the melted aluminum in the chamber 16 prevents the pressurized gas in the vessel 12 from passage 24 and reaching the interior of mold 20 since the interior of the mold 20 is fluidically isolated from direct communication with the interior of the pressure vessel, a pressure differential is created between the interior of the vessel 12 and the interior of the mold chamber 16. This pressure differential results in the melted aluminum being forced down through the passage 24 and through the porous ceramic filter 26, and into the mold 20, as shown in FIG. 1D. The amount of melted aluminum that is forced into the mold 20 and consequently the preform 22 corresponds to the amount of pressure in the vessel 12 at the surface of the melted aluminum in the crucible 14. The more pressure in the vessel, the more fluid is forced into the mold 20 and preform 22 to compensate for the difference in the pressure between the inside of the mold 20 and the inside of the vessel 12. As the aluminum is forced into the preform 22, the pressure is equalized between the inside of the mold 20 and the inside of the vessel 12 itself. By controlling the pressurization rate, it is possible to control the difference between the pressure on the inside and outside of the mold 20. The slower the rate, the lower the pressure exerted on the outside of the mold 20 and so a thinner or lower strength wall thereof is required. Quick pressurization rates require heavy walls to withstand the pressures exerted on the walls of the mold 20.

After the melted aluminum fills the perform 22, the lifter 32, which can be in the form of a pneumatic piston passing through the vessel and sealed with an o-ring, lifts the chill plate 30 into thermal contact with the bottom of mold 20. This causes the melted aluminum in mold 20 nearest the water cooled chill plate 30 to solidify. This solidification of the melted aluminum propagates as a wave from the bottom of mold 20. The pressurization means remains active during this directional solidification allowing extra melted aluminum to fill the mold 20 as the aluminum in the mold 20 cools and thus shrinks.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for casting comprising:

a pressure vessel;

means for pressurizing the vessel, said pressurizing means fluidically connected to the vessel;

a chamber disposed in the pressure vessel within which material is melted;

a mold adapted to contain a preform and disposed in the pressure vessel and in fluidic connected with the chamber by a passage such that melted material in the chamber can be forced down into the mold through the passage as the pressurizing means pressurizes the vessel, said passage contains a filter such that the melted material is prevented from entering the interior of the mold prior to pressurization but passes through the filter upon a desired pressurization;

means for heating material in the chamber and the mold such that material is melted in the chamber and stays melted as it is forced down into the mold while the pressurizing means pressurizes the vessel, said heating means disposed in the vessel;

a chill plate for cooling the mold: and a chill plate lifter, separable from said mold, for selectively moving the chill plate into and out of contact with the bottom of the mold.

2. An apparatus as described in claim 1 wherein the heating means includes a furnace for heating the mold and material within the chamber.

3. An apparatus as described in claim 2 wherein said chill plate is cooled with a circulating liquid.

4. An apparatus as described in claim 1 including means for evacuating the vessel, said evacuating means fluidically connected to the pressure vessel.

5. An apparatus as described in claim 4 including means for controlling the rate at which pressurization occurs such that the pressure in the mold is able to have time to be driven toward instantaneous equilibrium with the vessel pressure.

6. A method for casting comprising the steps of:

loading a pressure vessel by disposing a material within a crucible whereby the crucible is in fluidic connection with a mold containing a preform through a passage, said passage having a filter disposed therein;

melting the material in the crucible wherein the melted material fluidically seals the passage thereby isolating the interior of the mold from the interior of the vessel, said filter prevents melted material from entering the interior of the mold;

pressurizing the vessel such that the melted material is forced past said filter and down into the interior of the mold and into the preform; and cooling the melted material within the mold by lifting a separable chill plate into thermal contact with the bottom of the mold.

7. A method as described in claim 6 including before the melting step, the step of evacuating the pressure vessel.

8. An apparatus for casting comprising:

a pressure vessel comprising a melt section and a mold section separated by a surface, said melt section disposed in the upper portion of the pressure vessel, said melt section comprising a crucible within which material is stored and melted, a first hole disposed on the crucible's bottom surface and a second hole disposed under said first hole in the surface and a plug lift system comprising a plug and a plug lifter whereby the plug lifter raises and lowers the plug into and out of the first hole such that when the plug is lowered into the first hole, the melted material cannot flow out of the crucible, said mold section is disposed in the lower portion of said pressure vessel, said mold section comprising a chamber under said second hole for holding said melted material;

means for pressurizing the vessel, said pressurizing means in fluidic connection with the vessel;

a mold adapted to contain a preform and having a passage fluidically connecting said chamber to the interior of said mold, said passage includes a filter such that the melted material is prevented from entering the interior of the mold prior to pressurization; and means for heating material in the crucible such that material is melted in the crucible and stays melted as it flows downward into the chamber of the mold section as the plug lifter lifts the plug away from the hole of the crucible; and a chill plate for cooling the mold; and a chill plate lifter, separable from said mold, for selectively moving the chill plate into and out of thermal contact with the bottom of the mold.

9. An apparatus as described in claim 8 wherein the melt heating means includes a furnace for heating the material within the crucible.

10. An apparatus as described in claim 9 wherein said chill plate is cooled with a circulating liquid.

11. An apparatus as described in claim 8 including means for heating the mold within said mold section such that the melted material does not solidify as it enters the mold.

12. An apparatus as described in claim 11 wherein the heating means includes a mold furnace for heating the mold.

13. An apparatus as described in claim 8 including means for evacuating the vessel, said evacuating means in fluidic connection with the vessel; and means for controlling the rate at which pressurization occurs such that the pressure in the mold chamber is able to have time to be driven toward instantaneous equilibrium with the vessel pressure.

14. A method for casting comprising the steps of:

loading a pressure vessel by disposing a mold within a mold section of the vessel, said mold includes an interior, a chamber and a passage therebetween, said passage has a filter disposed therein, said interior has a preform disposed within;

placing a crucible containing material within a melt section of the vessel such that a plug of a plug lift system of the vessel seals a hole of the crucible through which melted material can flow;

melting the material with the crucible such that the plug of the plug lift system prevents the material from flowing out of the hole;

lifting the plug with said plug lift system thereby allowing the melted material to flow through the hole of the crucible and into the chamber of the mold section, whereby the filter of the mold prevents the melted material from entering the interior of the mold;

pressurizing the vessel at a controlled rate such that the melted material is forced past said filter and into the interior of the mold and into the preform therein; and cooling the melted material within the mold by lifting a separable chill plate into thermal contact with the bottom of the mold.

* * * * *

UNITED STATES PATENT AND TRADEMARK OFFICE

CERTIFICATE OF CORRECTION

PATENT NO. : 5,111,870

DATED : May 12, 1992

INVENTOR(S) : Arnold J. Cook

It is certified that error appears in the above-indentified patent and that said Letters Patent is hereby corrected as shown below:

In the abstract, line 2, delete "evacuating and".

In the abstract, line 3, delete "evacuating and".

In the abstract, last line, replace "disclose" with -- discloses -- .

In the abstract, last line, after "top fill" insrt -- mold -- .

Column 1, line 52, replace "An apparatus" with -- The present invention relates to an apparatus for casting which -- .

Column 1, line 53, delete "evacuating and".

Column 1, line 54, delete "evacuating and".

Column 1, line 66, replace "mod" with -- mold -- .

Column 2, line 34, delete "and evacuating".

Column 2, line 34, after "the vessel.", insert -- Preferably, the apparatus 10 also includes means for evacuating the vessel -- .

UNITED STATES PATENT AND TRADEMARK OFFICE

CERTIFICATE OF CORRECTION

PATENT NO. : 5,111,870

DATED : May 12, 1992

INVENTOR(S) : Arnold J. Cook

It is certified that error appears in the above-indentified patent and that said Letters Patent is hereby corrected as shown below:

Column 3, line 31, after "melt section" insert --36--.

Signed and Sealed this

Second Day of November, 1993

Attest:

Bruce Lehman

BRUCE LEHMAN

Attesting Officer

Commissioner of Patents and Trademarks